US010220243B2

(12) United States Patent
Koegel

(10) Patent No.: US 10,220,243 B2
(45) Date of Patent: Mar. 5, 2019

(54) EXERCISE SYSTEM

(71) Applicant: Christian Koegel, Boca Raton, FL (US)

(72) Inventor: Christian Koegel, Boca Raton, FL (US)

( * ) Notice: Subject to any disclaimer, the term of this patent is extended or adjusted under 35 U.S.C. 154(b) by 0 days.

(21) Appl. No.: 15/335,808

(22) Filed: Oct. 27, 2016

(65) Prior Publication Data

US 2018/0117390 A1 May 3, 2018

(51) Int. Cl.
*A63B 21/00* (2006.01)
*A63B 21/04* (2006.01)
(Continued)

(52) U.S. Cl.
CPC ..... *A63B 21/4035* (2015.10); *A63B 21/0442* (2013.01); *A63B 21/0557* (2013.01);
(Continued)

(58) Field of Classification Search
CPC ..... A63B 21/0004; A63B 21/00043; A63B 21/00047; A63B 21/00058; A63B 21/00061; A63B 21/00065; A63B 21/00069; A63B 21/00072; A63B 21/00076; A63B 21/00178; A63B 21/00181; A63B 21/00185; A63B 21/002; A63B 21/0023; A63B 21/008; A63B 21/0085; A63B 21/02; A63B 21/04; A63B 21/0407; A63B 21/0414; A63B 21/0421; A63B 21/0428; A63B 21/0435; A63B 21/0442; A63B 21/05; A63B 21/055; A63B 21/0552; A63B 21/0555; A63B 21/0557; A63B 21/06; A63B 21/0615; A63B 21/065; A63B 21/068; A63B 21/072; A63B 21/0726; A63B 21/075; A63B 21/08; A63B 21/15; A63B 21/159; A63B 21/4023; A63B 21/4027; A63B 21/4033; A63B 21/4034; A63B 21/4035; A63B 21/4039;
(Continued)

(56) References Cited

U.S. PATENT DOCUMENTS 4,801,140 A 1/1989 Bergeron
6,422,983 B1 * 7/2002 Weck ..... A63B 21/0004 482/146
(Continued)

*Primary Examiner* — Gary D Urbiel Goldner
(74) *Attorney, Agent, or Firm* — Melvin K. Silverman

(57) ABSTRACT

An exercise system, in a first mode of operation, provides for strengthening of legs of a user and enhancing the user's ability to develop and maintain balance and, in a second mode of operation, for providing various forms of core, arm, and upper body training. The system includes two resilient hemispheres each having a projecting dome and, on an opposite side, a rigid substantially flat weighted base in relationship about each hemisphere and a circumferential ring is proportioned to engage a periphery of the base of each hemisphere. An outer area of the periphery of each base includes elements with connecting rings secured to the engagement elements. Resistance training bands of selectable resistance are securable to one or plural connecting rings. A push-up handle of each hemisphere is press-fittably securable into an axial recess within the weighted base and selectably connects to different weights within the recess.

4 Claims, 9 Drawing Sheets

(51) Int. Cl.

| | |
|---|---|
| ***A63B 21/055*** | (2006.01) |
| ***A63B 21/075*** | (2006.01) |
| ***A63B 23/02*** | (2006.01) |
| ***A63B 23/04*** | (2006.01) |
| ***A63B 23/12*** | (2006.01) |

(52) U.S. Cl.
CPC ..... *A63B 21/075* (2013.01); *A63B 23/0205* (2013.01); *A63B 23/04* (2013.01); *A63B 23/1236* (2013.01)

(58) Field of Classification Search
CPC . A63B 21/4043; A63B 21/4047; A63B 22/14; A63B 22/16; A63B 22/18; A63B 2022/185; A63B 23/02; A63B 23/0205; A63B 23/0211; A63B 23/0216; A63B 23/0222; A63B 23/035; A63B 23/03508; A63B 23/03516; A63B 23/0355; A63B 23/03575; A63B 23/04; A63B 23/0405; A63B 23/0458; A63B 23/0482; A63B 23/0494; A63B 23/08; A63B 23/12; A63B 23/1209; A63B 23/1236; A63B 23/1245; A63B 23/1281; A63B 26/00; A63B 26/003; A63B 2208/02; A63B 2208/0204; A63B 2208/0209; A63B 2208/0295; A63B 2225/09; A63B 2225/093; A63B 2225/10
See application file for complete search history.

(56) References Cited

U.S. PATENT DOCUMENTS 6,461,285 B1 * 10/2002 Theunissen ..... A63B 26/003 273/110
6,554,753 B1 4/2003 Weck
6,575,885 B1 6/2003 Weck
6,740,008 B1 * 5/2004 Ho ..... A63B 21/0004 482/123
D517,136 S * 3/2006 Chen ..... D21/671
7,585,262 B1 * 9/2009 Vayntraub ..... A63B 23/12 482/141
D627,015 S * 11/2010 Senegal ..... D21/662
7,909,746 B2 * 3/2011 Gant ..... A63B 21/00047 482/141
8,105,218 B1 * 1/2012 Vayntraub ..... A63B 23/1236 482/141
8,105,220 B2 * 1/2012 Schultheisz ..... A63B 21/0004 472/14
8,357,077 B2 1/2013 Taylor
8,382,647 B1 * 2/2013 Hodes ..... A63B 21/072 482/108
8,454,485 B1 * 6/2013 Hodes ..... A63B 21/0726 482/108
8,814,768 B1 * 8/2014 Yang ..... A63B 22/18 482/121
D724,162 S * 3/2015 James ..... A63B 23/1236 D21/688
9,108,086 B1 * 8/2015 Weck ..... A63B 21/072
9,192,814 B1 * 11/2015 Smart ..... A63B 21/072
9,320,940 B2 * 4/2016 Rainey ..... A63B 26/003
9,533,191 B2 * 1/2017 Carbone ..... A63B 26/003
9,744,397 B2 * 8/2017 Pagano ..... A63B 21/0557
2003/0125174 A1 * 7/2003 Lin ..... A63B 21/154 482/148
2004/0142801 A1 * 7/2004 Lin ..... A63B 21/0004 482/142
2005/0009677 A1 * 1/2005 Yang ..... A63B 5/11 482/142
2005/0049123 A1 * 3/2005 Dalebout ..... A63B 21/04 482/142
2006/0030463 A1 * 2/2006 Maloy ..... A63B 23/1245 482/126
2007/0155601 A1 * 7/2007 Dykgraaf ..... A63B 21/0004 482/140
2007/0225133 A1 * 9/2007 Castro ..... A63B 21/0004 482/140
2010/0261590 A1 * 10/2010 Fares ..... A63B 21/00047 482/131
2010/0279833 A1 * 11/2010 Gant ..... A63B 21/00047 482/141
2011/0143896 A1 * 6/2011 Senegal ..... A63B 22/18 482/139
2013/0017937 A1 * 1/2013 Guarrasi ..... A63B 26/00 482/142
2013/0123079 A1 * 5/2013 Peritz ..... A63B 22/14 482/139
2013/0137555 A1 * 5/2013 Hodes ..... A63B 21/0726 482/106
2013/0190150 A1 * 7/2013 Delisle ..... A63B 21/075 482/141
2013/0288866 A1 * 10/2013 Rainey ..... A63B 26/003 482/146
2013/0316886 A1 * 11/2013 Lynch ..... A63B 26/003 482/146
2014/0162858 A1 * 6/2014 Dalebout ..... A63B 23/02 482/142
2014/0194258 A1 * 7/2014 Shorter ..... A63B 21/072 482/93
2015/0190672 A1 * 7/2015 Rost ..... A63B 23/0355 482/93
2017/0021218 A1 * 1/2017 Peritz ..... A63B 21/4035
2017/0021220 A1 * 1/2017 Pagano ..... A63B 22/18

* cited by examiner

EXERCISE SYSTEM

BACKGROUND OF THE INVENTION

A. Area of the Invention

The invention relates to an exercise system which employs multiple exercise elements and is sufficiently compact for use by travelers.

B. Prior Art

Exercise systems which make use of a resilient sphere or hemisphere have been known in the art for some time. For example, see U.S. Pat. No. 4,801,140 (1989) to Bergeron, and U.S. Pat. No. 8,357,077 (2013) to Taylor et al. Perhaps best known in the art is the BOSUBALL Single Hemisphere Exercise Device, which is reflected in various patents including U.S. Pat. Nos. 6,575,885, and 6,554,753 and various other patents, all held by Weck et al. None of these patents or the inventions thereof are directed to a concurrent use of multiple resilient hemispheric elements for exercise of other purposes. Accordingly, the exercises which may be considered in the use of such prior art are inherently limited.

Further, relatively few patents are concerned with exercises for the improvement of one's balance. However, included in this category is U.S. Pat. No. 3,716,229 (1973) to Van Der Cleyen et al, U.S. Pat. No. 5,897,474 (1999) to Romero, and U.S. Patent Application Serial No. 2013/0316886 (2013) to Lynch et al.

In summary, the use of multiple hemispherical elements with other components of the larger exercise system do not appear in any prior art of which the within inventor is aware.

SUMMARY OF THE INVENTION

An exercise system, in a first mode of operation, provides use of a pair of hemispheres for strengthening of the legs of a user and enhancing the user's ability to develop and maintain balance and, in a second mode of operation for providing various forms of core, arm, and upper body training. The system comprises a pair of resilient hemispheres, each having a projecting dome and, on a bottom of each hemisphere, a rigid substantially flat base extending peripherally about each hemisphere; a circumferential peripheral ring proportioned to engage said periphery of the base of the resilient hemisphere; an outer area by the periphery including two strap means; and handles therefore connecting means, each securable at opposite sides of the base of each hemisphere; engagement means; and resistant training bands of selectable resistance securable at one end thereof to said connecting means and at an opposite end thereof of said handles.

It is an object of the present invention to provide an exercise system which is compact enough for use by travelers, packable in one's luggage and versatile enough to enable performance of a number of important fitness exercises by persons of varying physical characteristics and degrees of fitness.

It is a further object to provide an exercise system for improvement of the balance of a user while strengthening of the lower body.

It is another object to provide a system of the above type that may be readily converted into an assembly for upper body, core and arm exercises.

The above and yet other objects and advantages of the present invention will become apparent from the hereinafter Brief Description of the Drawings, Detailed Description of the Invention and Claims appended herewith.

DETAILED DESCRIPTION OF THE INVENTION

Figure 1:
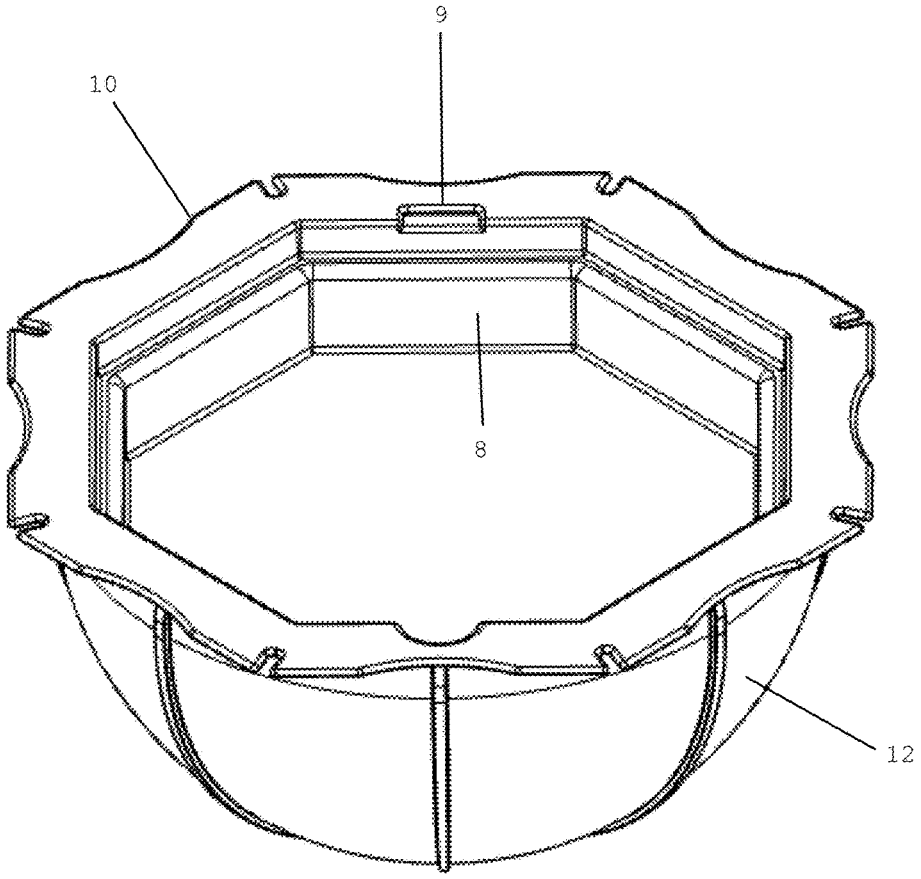
FIG. 1 is a top perspective view of one hemisphere of the inventive exercise device, showing a bottom cover thereof in phantom.

It is noted that an exercise system in a first mode of operation, for strengthening legs (FIG. 8) of a user and enhancing the user's ability to develop and maintain balance and, in a second mode of operation (see FIG. 9) for providing various forms of core, arm, and upper body training of the exercise system includes a pair of resilient hemispheres, each having a projecting dome 12 and, on an opposite side thereof, a rigid substantially flat weighted base 14 (see FIGS. 3-6) in fluid-tight peripheral relationship about a circumference edge 10 (FIG. 1) of each resilient hemisphere 12; a periphery of the rigid substantially flat weighted base 14 of each resilient hemisphere 12 having at least one engagement element 9; at least one connecting ring 24 each secured to a corresponding engagement element 9 of the weighted base 14; resistant training bands 25 of selectable resistance secured at one end thereof to one or more connecting ring 24; resistance band handle 29 securable to opposite sides of each selected resistance band, and to each resilient hemisphere a push-up handle 16 securable into a recess 15 within each base of each hemisphere 12. See FIG. 3.

Figure 2:
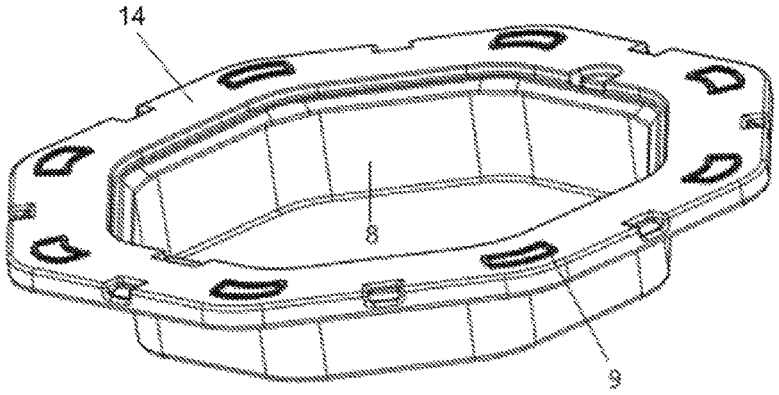
FIG. 2 is a top plan view of FIG. 1.

With reference to the perspective views of FIGS. 1 and 2, and side of an upper hemisphere or dome 12, inner in which said hemisphere 12 is defined by the rigid substantially flat weighted base 14. See FIGS. 3 to 5. It should be appreciated that various resilient properties of the dome 12 relative to weighted base 14 may be accomplished by methods that are air pressure, these, for example, including the use of foam or other resilient materials to impart to the dome 12 of each hemisphere a desired property or degree of resilience. While the figures show each hemisphere as a substantially dome-like element, it is to be appreciated that within the scope of the present invention, such hemispheres may be replaced by a plurality of resilient disk-like elements 11 to achieve the same effect. See FIG. 7.

In the embodiments discussed herein, the rigid substantially flat weighted base 14 includes the recess 15 which is substantially planar, circular, and annular (see FIGS. 3 and 5), such that a so-called push-up handle 16 and its base plate 22 can be twist-fit by the connection 27 thereinto (see FIGS.

5 and 6) after selected interchangeable weights 20 have been engaged at the inner side of the base plate 22. See FIGS. 4, 6 and 7. Such a twist fit connection 27 permits rotation of the wrists and arms during push-ups. See FIG. 9. The purpose of such variously weighted push-up handles 16 used with the interchangeable weights 20 (see FIG. 4) is two-fold, the first being to provide the ability to modify the degree of difficulty of upper body exercise of the type shown in FIG. 9 and, secondly, a selection of a degree of stability of the exercise hemisphere 12 that is comfortable to the user. Further, exercise handles 16 and their associated base plate 22 may be employed as free weights, if released from weights 20 for release clips 23, in any number of different upper body exercises. See FIGS. 4, 8 and 9.

Figure 3:
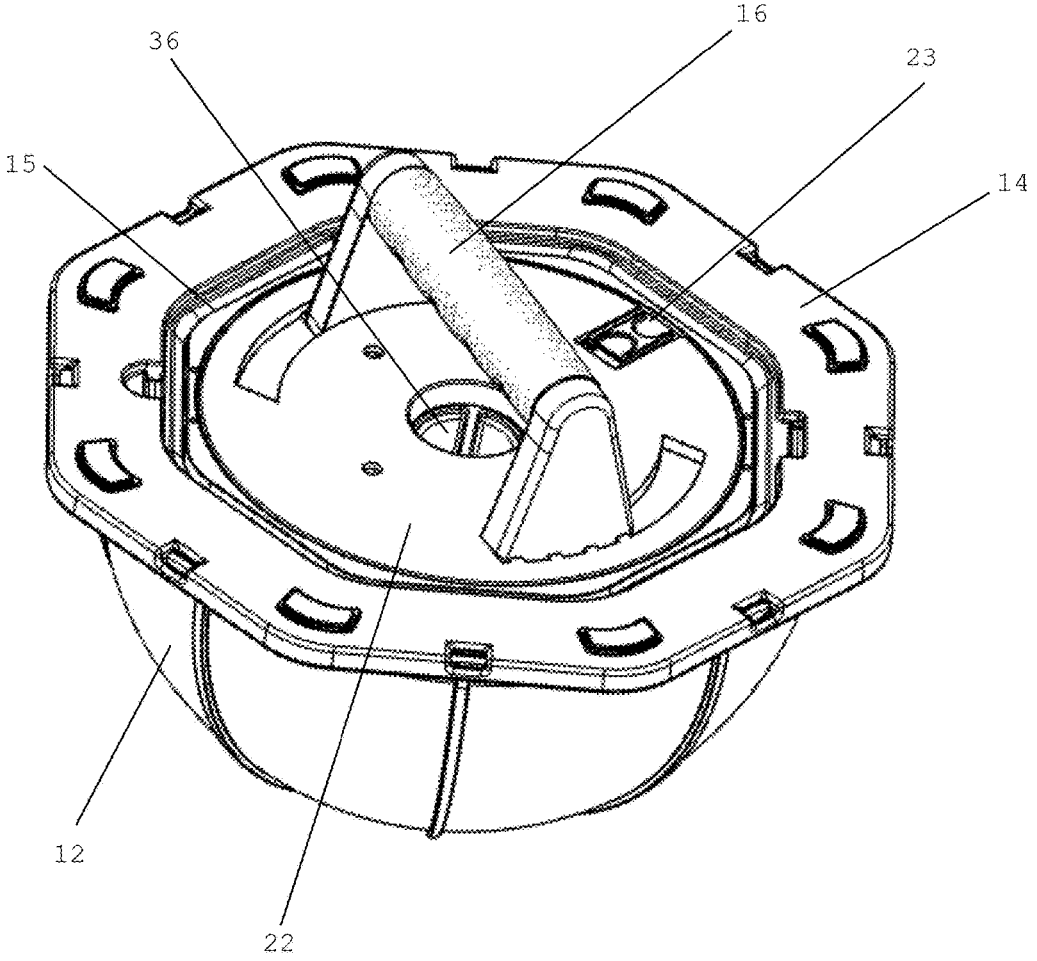
FIG. 3 is a bottom perspective view of one hemisphere of the exercise device showing a handle of the device after placement thereinto.
Figure 4:
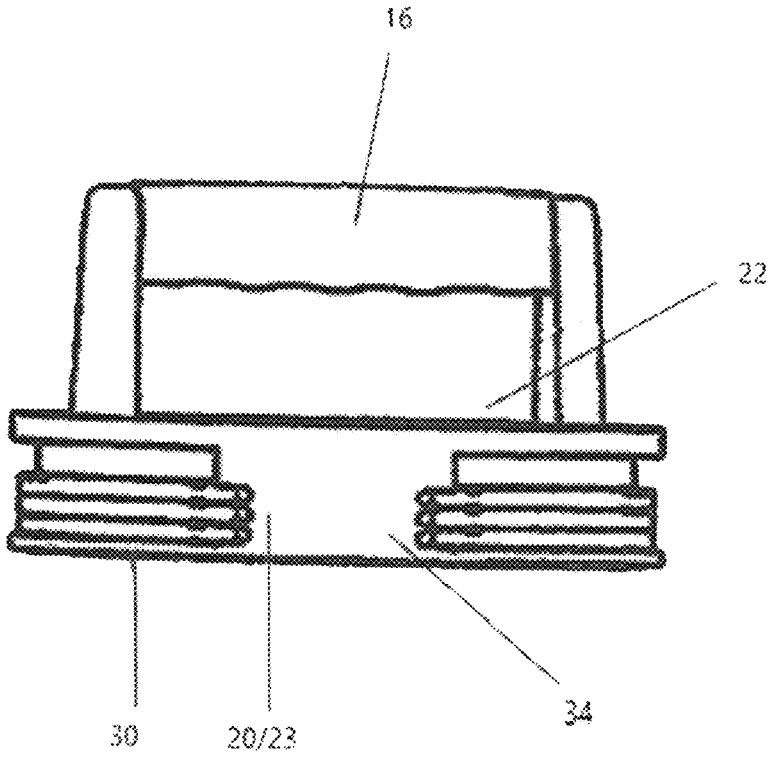
FIG. 4 is a front elevational view of a handle assembly of the device with associated selectable weighting elements.
Figure 5:
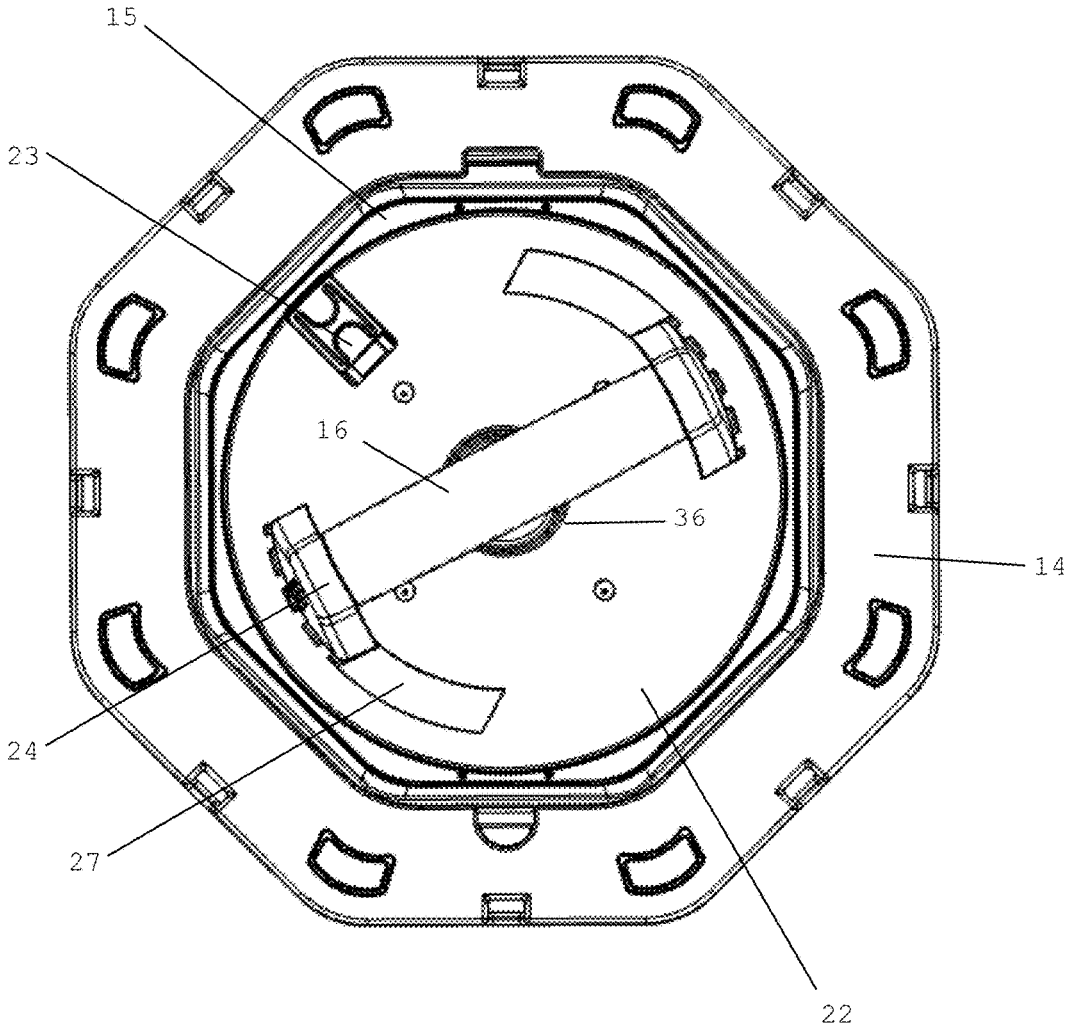
FIG. 5 is a bottom view showing the locking into place of a handle of the system.
Figure 6:
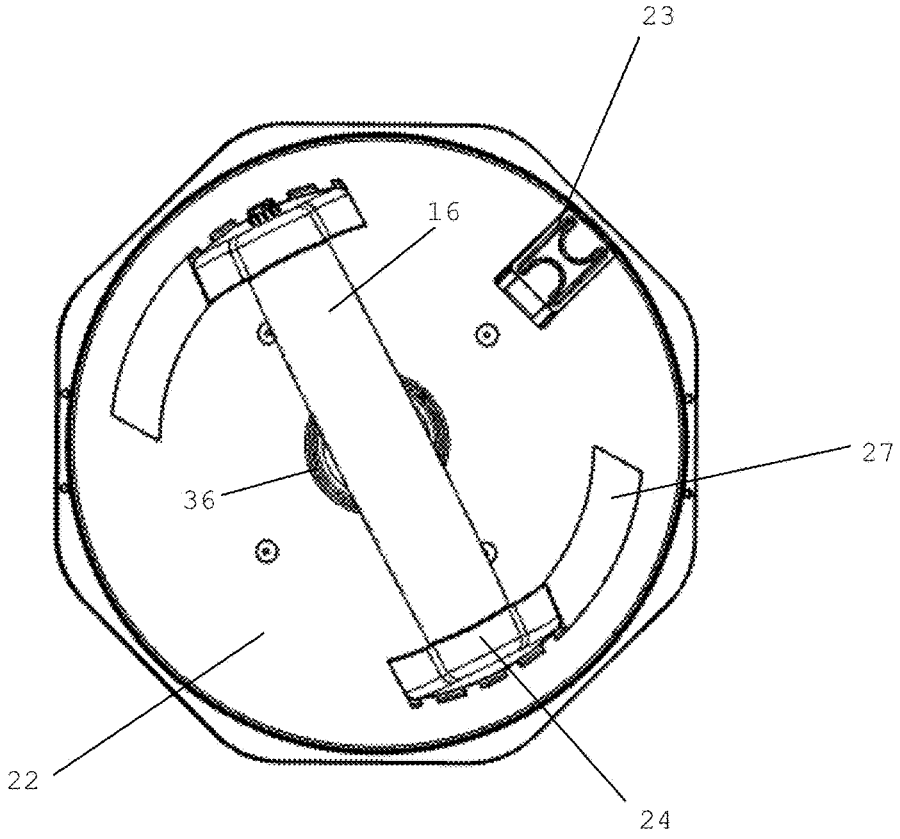
FIG. 6 is a plan view of the center handle area of FIG. 5.

As may be further noted in FIGS. 3 and 5, each hemisphere is preferably provided with said rigid substantially flat weighted base 14. The at least one connecting ring 24 is provided upon said rigid substantially flat weighted base 14. See FIG. 8. Said at least one connecting rings 24 are in turn selectably connectable to a variety of resistance bands 25 and to associated resistance band handles 29 (see FIG. 8) or other means that connect to said band 25. Further, the resistance bands 25 may be color coded to match the weight level of selectable color coded push-up plates 20. See FIG. 4. Thereby, a rather slight individual would use Level 1 resistance bands (color-coded blue) in combination with Level 1 weighted push-up bands (also color-coded blue). At the other extreme, a very muscular or large individual would select the highest level resistance band (color-coded black) and, for those upper body exercises shown in FIGS. 4 and 9, would employ the heaviest push-up plates also color-coded black.

As may be seen in FIGS. 3, 4, 5 and 6, each push-up handle 16 and associated handle weighted base plate 22 may be twist-fittably locked 27 into recess 15 about said rigid substantially flat weighted base 14 of each hemisphere 12. This capability entails the use of an assembly 34 (FIG. 4) having a complemental spiral pattern to accomplish an interlock 24 between the push-up handle and the assembly 34 within recess 15. See FIGS. 4 and 5. A similar strategy may be employed in embodiments using flat resilient pads in lieu of hemisphere 12.

Figure 8:
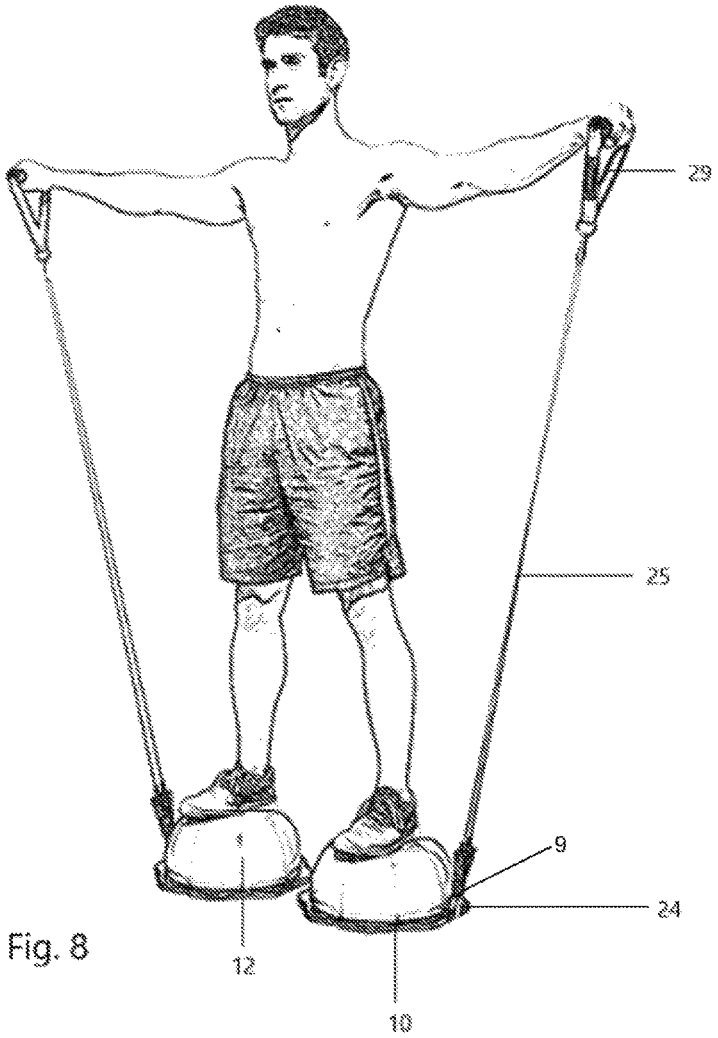
FIG. 8 is a view showing two of the devices of the system as used for lower body and leg exercises.
Figure 9:
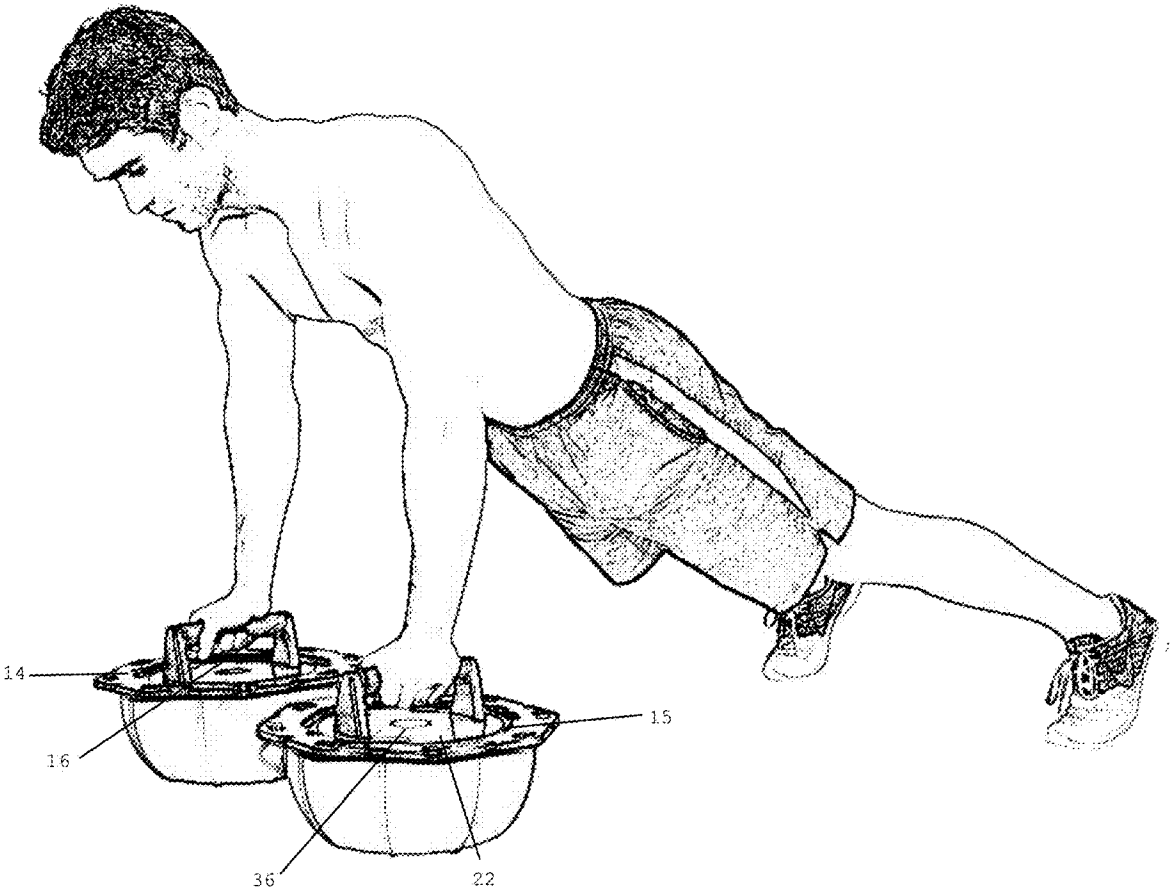
FIG. 9 is a view showing two of the devices as used for upper body exercises.

An internal weight may be employed within a resilient hemisphere 12 which is embedded within foam, compressed air or another resilient material to enhance stability as may be desirable for certain individuals given that, for many users, an objective of exercises of the type shown in FIGS. 8 and 9 is to enhance one's balance or stability upon a pair of hemispheres otherwise having an inherent degree of instability. However, for individuals for whom this is too difficult, a more stable type of element may be employed in lieu of hemisphere 12.

Figure 7:
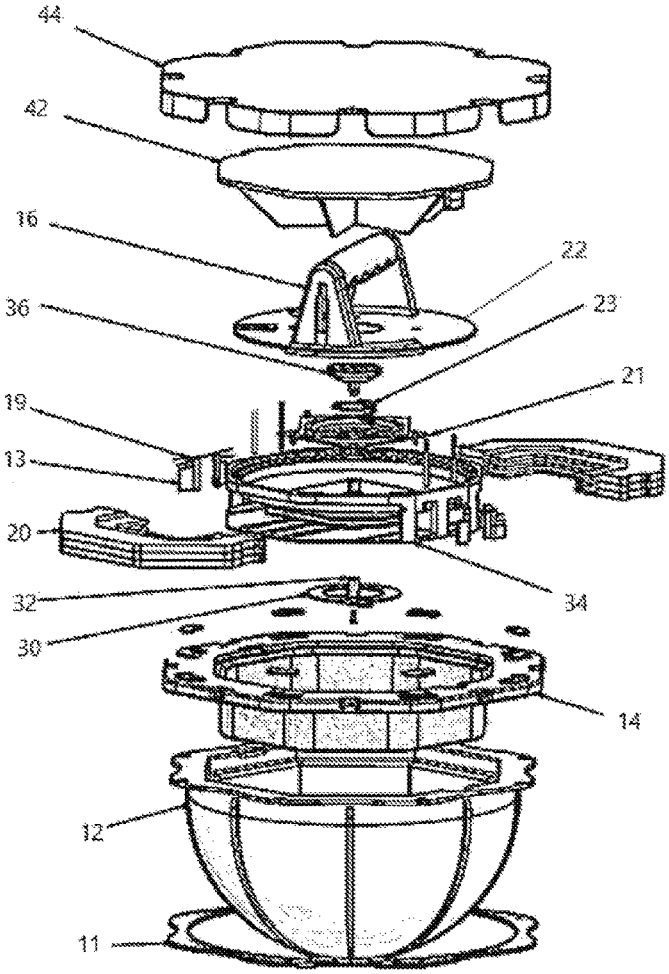
FIG. 7 is an exploded view of the elements of one hemisphere of the present system.

In the exploded view of FIG. 7 is shown said hemisphere 12, within the bottom of which fits said rigid substantially flat weighted base 14. Therein rubber pad 30 is first placed, followed by screw lock 32. Beneath rubber pad 30 is placed said assembly 34 into which weights 20 selectably fit. Therebelow is handle base plate 22. Handle 16 is held to the base plate by rotation lock 36, release clip 23 and handle 16 overlay of inside 22. Also provided are a handle cover 42 and a system cover 44.

It is to be appreciated that a preferred diameter of each hemisphere above described is in a range of about 14 to about 17 inches, while that of most single hemisphere exercise devices, such as BOSUBALL, exhibit a diameter of about 34 inches.

As above noted, the system set forth herein is particularly adapted in terms of its volume and weight for travelers and is practical for persons of all physical types and level of fitness.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. An exercise system, in a first mode of operation, for strengthening legs of a user and enhancing the user's ability to develop and maintain balance and, in a second mode of operation, for providing various forms of core, arm, and upper body training, the exercise system comprising:

(a) a pair of resilient hemispheres, each having a projecting dome and, on an opposite side thereof, a rigid substantially flat weighted base in fluid-tight peripheral relationship about and extending beyond a circumference edge of each resilient hemisphere;

(b) a periphery of the rigid substantially flat weighted base of each resilient hemisphere having one or plural elements of engagement;

(c) one or plural connecting rings each secured to a corresponding one of said one or plural elements of engagement of the rigid substantially flat weighted base;

(d) a selected training band of a plurality of training bands of selectable resistance for each of said resilient hemispheres secured at one end thereof to one of said one or plural connecting rings;

(e) a resistance band handle securable to another end of each of the selected training bands of the plurality of training bands of selectable resistance;

(f) for each resilient hemisphere a push-up handle securable into a recess within each rigid substantially flat weighted base of each resilient hemisphere; and (g) an assembly for each resilient hemisphere, wherein each assembly includes the corresponding push-up handle and a plurality of interchangeable weight plates selectably connectable to the corresponding push-up handle, wherein the plurality of interchangeable weight plates are configured to modify characteristics of push-ups accomplished with the push-up handle or for use as free weights when said push-up handle is disconnected from said rigid substantially flat weighted base.

2. The exercise system as recited in claim 1, wherein a size of the projecting dome of each resilient hemisphere is configured to define a dimension to accommodate a respective foot of the user while standing on each of said projecting domes and also while engaging the resistance band handles of the selected training bands, wherein the selected training bands are respectively attached at opposite ends of each resilient hemisphere wherein the pair of resilient hemispheres are configured for employment for use of the exercise system for the upper body training or the strengthening of the legs of the user with the two resilient hemispheres.

3. The exercise system as recited in claim 2, wherein said selected training bands comprise:

a plurality of bands corresponding in resistance and color to a color of said respective interchangeable weights of the corresponding push-up handle.

4. The exercise system as recited in claim 2, wherein a diameter of each resilient hemisphere defines a range of 14 inches to 17 inches.

* * * * *